US006098899A

United States Patent [19]

Rosenberg

[11] Patent Number: 6,098,899

[45] Date of Patent: Aug. 8, 2000

[54] PULSATING SPRAYING DEVICE

[76] Inventor: Peretz Rosenberg, Moshav Beit Shearim 30 046, Israel

[21] Appl. No.: 08/375,094

[22] Filed: Jan. 19, 1995

[51] Int. Cl.[7] ..... B05B 1/08

[52] U.S. Cl. ..... 239/99; 239/382

[58] Field of Search ..... 230/380, 381, 230/382, 99

[56] References Cited

U.S. PATENT DOCUMENTS

| | | | |
|---|---|---|---|
| 3,220,653 | 11/1965 | Waldrum | 239/99 X |
| 3,348,520 | 10/1967 | Lookwood | 239/99 |
| 4,081,135 | 3/1978 | Tomaro | 239/381 |

FOREIGN PATENT DOCUMENTS

| | | | |
|---|---|---|---|
| 955982 | 10/1979 | Canada | 239/281 |
| 1310028 | 5/1987 | U.S.S.R. | 239/99 |
| 94011112 | 5/1994 | WIPO | 239/381 |

*Primary Examiner*—Kevin Weldon
*Attorney, Agent, or Firm*—Benjamin J. Barish

[57] ABSTRACT

A pulsating spraying device includes a housing having an inlet for a liquid under pressure, and a plurality of discharge openings for discharging the liquid; an inlet chamber communicating with the housing inlet; a plurality of pulsating control chambers each having an inlet passageway on one side communicating with the inlet chamber, and an outlet passageway on the opposite side communicating with at least one of the discharge openings; and a plurality of oscillating members, one located in each of the fluid control chambers, configured to be rapidly oscillated by the flow of liquid into the respective pulsating control chamber via its inlet passageway, and to drive the liquid via its outlet passageway out of the respective discharge opening in the form of pulses.

18 Claims, 2 Drawing Sheets

FIG.4
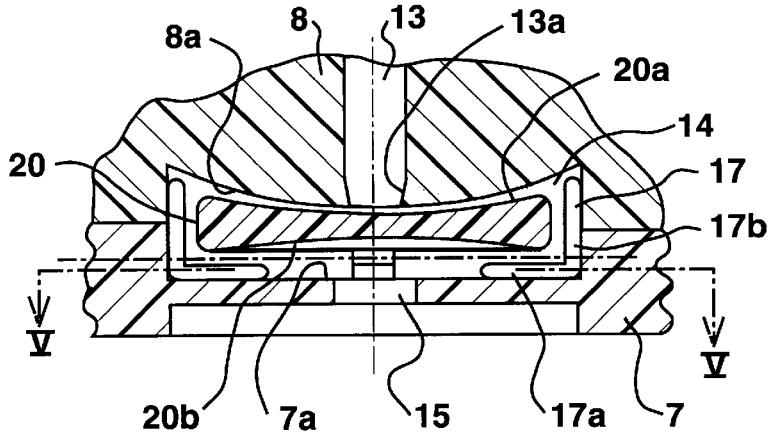
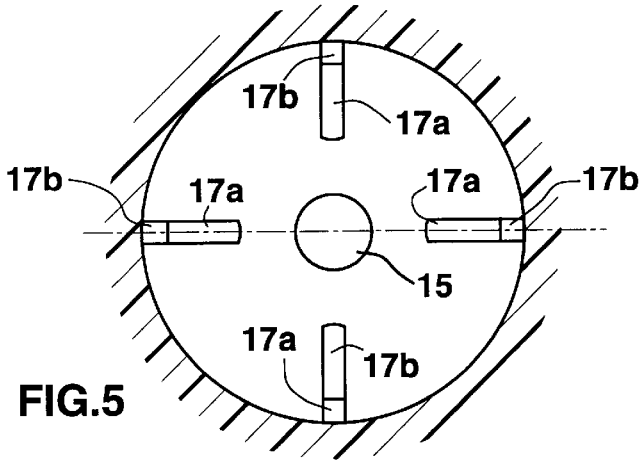
FIG.5
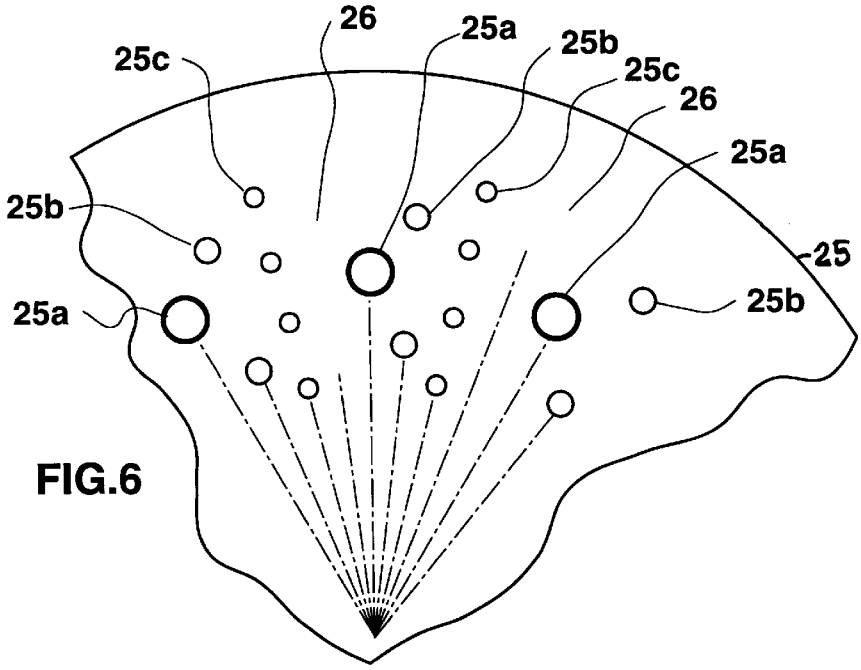
FIG.6

PULSATING SPRAYING DEVICE

RELATED APPLICATION

The present application is related to my patent application Ser. No. 08/138,285 filed Oct. 20, 1993, now U.S. Pat. No. 5,390,850 of Feb. 21, 1995.

FIELD AND BACKGROUND OF THE INVENTION

The present invention relates to pulsating spraying devices. The invention is particularly useful in showerheads, and is therefore described below with respect to this application, but it will be apprecited that the invention could also be used in other types of spraying devices, such as water sprayers for plants, atomizers, nebulizers, and the like.

My above-cited U.S. Pat. No. 5,390,850 discloses a fluid-flow control device which includes an oscillating member freely movable within a housing such that one face of the member opens and closes an inlet opening in the housing, and the opposite face of the member drives the fluid in the form of pulses out of an outlet opening located in the opposite side of the housing in axial alignment with the inlet opening.

The device described in that patent application is very similar to a dripper device described in my earlier U.S. Pat. No. 4,014,473, except that the modifications made to it enable it to serve as a high-frequency fluid pulsator for many applications other than for drip irrigation.

OBJECTS AND BRIEF SUMMARY OF THE PRESENT INVENTION

An object of the present invention is to provide a pulsating spraying device, based on the use of oscillating members such as described in the above-cited patent and patent application, but particularly useful in showerheads to obtain a pulsating spray discharge, although the devices could advantageously be used in other applications as will also be described below.

According to the present invention, there is provided a pulsating spraying device comprising: a housing having an inlet for a liquid under pressure, and a plurality of discharge openings for discharging the liquid; an inlet chamber communicating with the housing inlet; a plurality of pulsating control chambers each having an inlet passageway on one side communicating with the inlet chamber, and an outlet passageway on the opposite side communicating with at least one of the discharge openings; and a plurality of oscillating members, one located in each of the pulsating control chambers, configured to be rapidly oscillated by the flow of liquid into the respective pulsating control chamber via its inlet passageway, and to drive the liquid via its outlet passageway out of the respective discharge opening in the form of pulses.

According to further features in the described preferred embodiment, the plurality of discharge openings are formed in a selector disc of the housing in alignment with the outlet passageways. The selector disc includes at least first and second groups of discharge openings, and is movable to selectively align either group with respect to the outlet passageways of the pulsating control chambers. In the described preferred embodiment, the first group of discharge openings includes a single discharge opening for each of the pulsating control chambers, and the second group of discharge openings includes at least two discharge openings, each of smaller cross-sectional area than the discharge openings of the first group, for each of the pulsating control chambers.

As will be described more particularly below, such a pulsating spraying device is particularly useful as a showerhead to provide pulsating jets of a selected fineness. Such a spraying device also enables the use of larger discharge openings, thereby substantially reducing the sensitivity of the device to clogging and the need for frequent cleaning. A further important advantage in the new pulsating spraying device is that such device exhibits relatively good flow regulation, i.e., smaller variations in output with variations in line pressure.

Further features and advantages of the invention will be apparent from the description below.

BRIEF DESCRIPTION OF THE DRAWINGS

The invention is herein described, by way of example only, with reference to the accompanying drawings, wherein:

FIG. 4 is an enlarged fragmentary view more clearly illustrating the construction of one of the pulsating control chambers in the device of FIG. 1;

FIG. 5 is a sectional view along line V—V of FIG. 4; and

FIG. 6 is a fragmentary view illustrating a variation in the construction of the spraying device of FIGS. 1–5.

DESCRIPTION OF A PREFERRED EMBODIMENT

Figure 1:
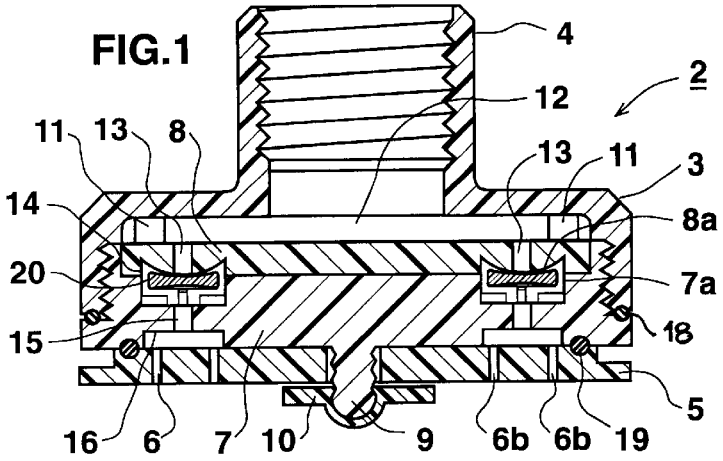
FIG. 1 is a longitudinal sectional view illustrating one form of pulsating spraying device constructed in accordance with the present invention.

The pulsating spraying device illustrated in the drawings is particularly for use as a showerhead in order to output a plurality of pulsating jets which can be selectively controlled by the user. Such a device also provides relatively good flow regulation, maintaining a substantially constant output despite variations in the inlet pressure.

As shown in FIG. 1, the device includes a housing, generally designated 2, including a main housing section 3 having an inlet 4, and a selector disc 5 formed with discharge openings 6 through which the water is discharged in the form of a plurality of pulsating jets. A closure plate or disc 7 is fixed by threads to close the end of the main housing section 3 opposite to that formed with the inlet 4. An intermediate plate or disc 8 is clamped to the main housing section 3 when the closure disc 7 is applied to the housing section. Closure disc 7 is formed with a central stem 9 which rotatably receives the selector disc 5 formed with the discharge openings 6 and is retained thereon by a retaining nut 10.

The inner surface of the main housing section 3 is formed with a plurality of projections or posts 11 which are engaged by the intermediate disc 8 to define an inlet chamber 12 communicating with the inlet 4. The intermediate disc 8 is further formed with a circular array of bores 13 which serve as inlet passageways to a circular array of pulsating control chambers 14 defined by the contacting faces of the intermediate disc 8 and closure disc 7. Thus, the intermediate disc 8 is formed with a circular array of cavities 8*a,* and the closure disc 7 is similarly formed with a circular array of cavities 7*a,* such that when the two discs are assembled together, the two series of cavities 7*a,* 8*a* together define a circular array of pulsating control chambers 14 each communicating with an inlet passageway 13 through the intermediate disc.

Figure 3:
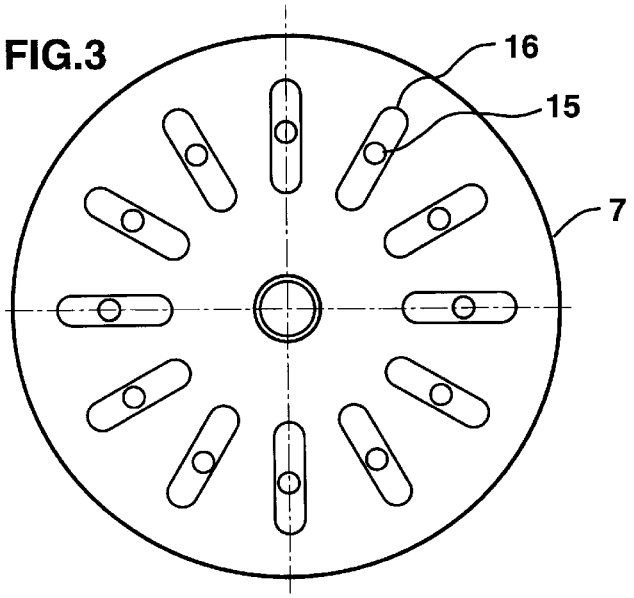
FIG. 3 is a plan view illustrating the housing closure plate in the device of FIG. 1.

The outlet passageways from chambers 14 are formed through the closure disc 7. Each outlet passageway is constituted of a bore 15 extending axially through closure disc 7, and a slot 16 extending radially of the disc, as shown particularly in FIG. 3. The radial slots 16 are formed on the outer face of the closure disc 7 facing selector disc 5, and are alignable with the discharge opening 6 formed in that disc. A seal 18 is provided between housing section 3 and closure plate 7, and another seal 19 is provided between closure plate 7 and selector disc 5.

Each of the circular array of pulsating control chambers 14 includes an oscillating member 20 which is freely movable within the chamber. Each oscillating member 20 is configured so as to be rapidly oscillated by the flow of water (or other liquid) into the respective fluid control chamber 14 via the inlet passageway 13, and to drive the liquid via its outlet passageway (bore 15 and slot 16) out of the respective discharge opening 6 in the form of high-frequency pulses.

The construction of each of the pulsating control chambers 14, and the oscillating member 20 within the chamber, is more particularly illustrated in FIGS. 4 and 5. Thus, as shown in FIG. 4, the inner face of each pulsating control chamber 14 through which the inlet passageway 13 is formed is of convex configuration. The end 13*a* of the inlet passageway 13 formed through the convex face of cavity 8*a* is slightly reduced in diameter. The outlet bore 15 from the respective pulsating control chamber 14 is axially aligned with the inlet passageway 13, and is of slightly larger diameter than end 13*a* of that passageway. The inner surface of each cavity 7*a* defining the outlet end of each of the pulsating control chambers 14 is formed with four spacer ribs 17 of L-shaped configuration, each including a leg 17*a* extending radially with respect to the outlet bore 15, and a leg 17*b* extending axially with respect to that bore.

Each oscillating member 20 disposed within each pulsating control chamber 14 is in the form of a thin, inperforate disc of concave configuration on its opposite faces 20*a*, 20*b*. Face 20*a* facing the inlet passageway 13, is formed with a radius of curvature slightly larger than that of the convex face of cavity 8*a* such that the two faces diverge away from each other from the inlet passageway 13. Concave face 20*b* on the opposite side of disc 20 is preferably of the same configuration as concave face 20 so that the discs 20 may be inserted with either face facing the inlet passageway 13 when assembling the device.

Each disc 20 is of an overall thickness to permit axial oscillatory movement of the disc toward and away from the inner end 13*a* of the inlet passageway 13. During the oscillations of each disc, its face 20*a* moves into and out of contact with the convex face of the respective pulsating control chamber 14 to close and open the inlet passageway 13.

The radially-extending legs 17*a* of ribs 17 are engageable by face 20*b* of each disc 20 to space the disc from the respective face of the pulsating control chamber 14, and thereby to prevent the disc from completely closing the outlet bore 15. The axially-extending legs 17*b* of ribs 17 are engageable by the outer periphery of the disc 20 to maintain a continuous flow between the opposite faces of the disc, and thereby a continuous flow of the water through the pulsating control chambers 14 to the outlet passageways 15, 16.

Figure 2:
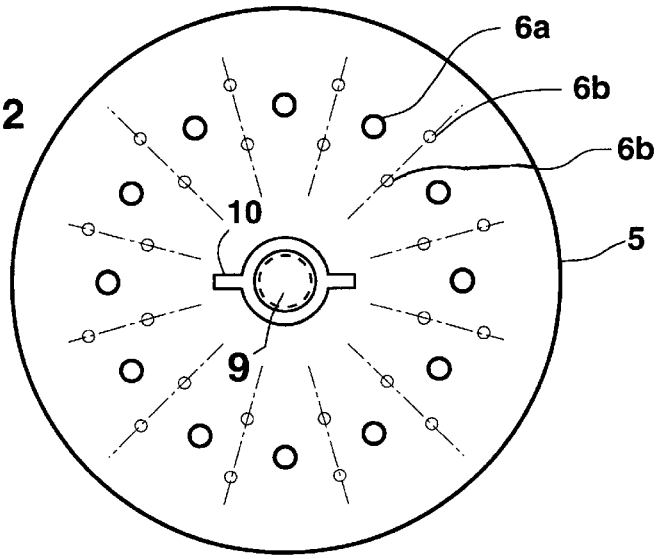
FIG. 2 is a plan view illustrating the discharge end of the device of FIG. 1.

The external selector disc 5 enables the user to select the type of pulsating spray to be discharged from the device. In the example illustrated in FIG. 2, this disc is formed with two groups of discharge openings, shown at 6*a* and 6*b*, respectively; each group is selectively alignable with the radial slot 16 in the outlet passageway from each of the pulsating control chambers 14. In the example illustrated in FIGS. 1–3, the device includes a circular array of twelve pulsating control chambers, and therefore selector disc 5 includes a first group of twelve discharge openings 6*a* interlaced with a second group of twenty-four discharge openings 6*b*. The first group of discharge openings 6*a* includes but a single opening alignable with the radial slots 16 in the outlet passageways of the pulsating control chambers 14; whereas the second group of discharge openings 6*b* includes two openings, each of smaller cross-sectional area than opening 6*a* and in radial alignment with each other, so as to be alignable with the radial slot 16 of the outlet passageways in the respective pulsating control chambers 14.

FIG. 1 illustrates selector disc 5 in the position wherein the two smaller openings 6*b* are in alignment with the outlet passageways from the respective pulsating control chambers 14, and therefore the device will discharge a plurality (24 in this case) of small-diameter pulsating jets from the discharge openings 6*b*. If a coarser spray is desired, the user would rotate selector disc 5 to align the larger-diameter discharge openings 6*a* with the radial slots 16 in the outlet passageways of the pulsating control chambers 14, whereby the device will output twelve pulsating jets of larger diameter.

The illustrated device is used in the following manner: The user first selects the type of pulsating spray to be produced. If a finer pulsating spray is desired, the user rotates selector disc 5 to the position illustrated in FIG. 1, wherein the small-diameter discharge openings 6*b* are aligned with the radial slots 16 in the outlet passageways from the pulsating control chambers 14; and if a coarser spray is desired, selector disc 5 would be rotated to align the larger-diameter discharge openings 6*a* with the radial slots 16.

When the water is turned on, the water flows through the inlet 4, the inlet chamber 8, and the inlet passageways 13 into the circular array of pulsating control chambers 14. Because of the difference in the radii of curvature between the concave faces 20*a* of the oscillating discs 20 in each chamber 14, and the convex face through which the inlet passageway 13 is formed, a pressure gradient is produced between these two faces. This pressure gradient tends to draw each disc 20 towards and in contact with the convex face of the respective chamber 14, thereby reclosing the end 13*a* of the inlet passageway 13. When the inlet passageway 13 is thus closed, the pressure of the water in the inlet passageway 13 again moves the disc 20 away from end 13*a*. Each disc 20 is thus set into rapid oscillation, with concave face 20*a* of the disc rapidly closing and opening the inlet passageway 13. This rapid oscillation of each disc 20 causes its opposite concave face 20*b* to drive the water out of the outlet passageway of the respective chamber 14 (i.e., through bore 15 and its radial slot 16) in the form of high-frequency pulses.

If the selector disc 5 is located in the position illustrated in FIG. 1, these high-frequency pulses will be discharged via the small-diameter openings 6*b* in the form of fine pulsating jets. If, however, coarser pulsating jets are required, selector disc 5 would be located to align the larger-diameter discharge openings 6*a* with slots 16.

The device illustrated in FIGS. 1–5 is thus capable of selecting two types of pulsating jet outlets. It will be appreciated, however, that other types of pulsating jet outlets may be provided by merely including the appropriate openings in the selector disc 5.

FIG. 6, for example, shows a selector disc, therein designated 25, which is formed with a first group of relatively large-diameter discharge openings 25*a,* interlaced with a second group of two discharge openings 25*b* of smaller diameter than discharge openings 25*a,* and with a third group of discharge openings 25*c* of larger number but of even smaller diameter. As described above with respect to FIG. 2, each group of discharge openings is formed along radial lines of the selector disc 25 so as to be alignable with the radial slots 16 in the outlet passageways of the pulsating control chambers 14.

FIG. 6 illustrates a further option that may be provided, namely interlaced radial sections 26 which are devoid of any discharge openings, such that the selector disc may also be used for closing-off or reducing the water discharge from the device.

As indicated earlier, the device illustrated in the drawings is particularly useful for showerheads. It will be appreciated, however, that it could also be used in many other applications, e.g., as sprayers for spraying plants, as nebulizers or atomizers to produce finely distributed drops of water, etc. Therefore, while the invention has been described with respect to one preferred embodiment (including a variation thereof), it will be appreciated that this is set forth merely for purposes of example, and that many other variations, modifications and applications of the invention may be made.

I claim:

1. A pulsating spraying device, comprising:

a housing having an inlet for a liquid under pressure, and a plurality of discharge openings for discharging the liquid;

an inlet chamber communicating with said housing inlet;

a plurality of pulsating control chambers each having an inlet passageway on one side communicating with said inlet chamber, and an outlet passageway on the opposite side communicating with at least one of said discharge openings;

and a plurality of oscillating members, one located in each of said pulsating control chambers, rapidly oscillated by the flow of liquid into the respective pulsating control chamber via its inlet passageway, to drive the liquid via its outlet passageway out of the respective discharge opening in the form of pulses;

said plurality of discharge openings being formed in a selector disc in alignment with said outlet passageways.

2. The device according to claim 1, wherein said selector disc includes at least first and second groups of discharge openings, and is movable to selectively align either group of discharge openings with respect to the respective outlet passageways of the pulsating control chambers.

3. The device according to claim 2, wherein said first group of discharge openings includes a single discharge opening for each of said pulsating control chambers, and said second group of discharge openings includes at least two discharge openings, each of smaller cross-sectional area than the discharge openings of said first group, for each of said pulsating control chambers.

4. The device according to claim 2, wherein said plurality of pulsating control chambers and their outlet passageways are arranged in a circular array around the axis of said housing, and said selector disc is rotatable about said axis of the housing to selectively align either group of discharge openings with respect to the respective outlet passageways of the pulsating control chambers.

5. The device according to claim 4, wherein each of said outlet passageways from a pulsating control chamber includes a slot extending radially of the housing, said housing selector disc being rotatable about the axis of the housing to align either group of discharge openings with the radially-extending slots of said outlet passageways.

6. The device according to claim 4, wherein said housing includes:

a main housing section formed at one side with said inlet;

a closure plate fixed to the opposite side of the main housing section;

and an intermediate plate between said main housing section and said closure plate;

said main housing section including spacer projections on its inner surface spacing the intermediate plate therefrom to define said inlet chamber;

said intermediate plate being formed with said plurality of inlet passageways through one face communicating with said inlet chamber, and being further formed in its opposite face with a plurality of cavities each communicating with one of said inlet passageways and each defining a part of the respective pulsating control chamber;

said closure plate also being formed with a plurality of cavities in one face defining the pulsating control chambers with the cavities of the intermediate plate, and being further formed with said outlet passageways through its opposite face alignable with the discharge openings in said selector disc.

7. The device according to claim 6, wherein said closure plate is formed with a central stem rotatably mounting said selector disc.

8. The device according to claim 1, wherein each of said oscillating members is an oscillating disc having one face facing the inlet passageway of the respective pulsating control chamber and configured to open and close said inlet passageway during the oscillations of the oscillating member; and wherein each of the pulsating control chambers is formed with spacer means spacing the opposite face of the oscillating disc from the face of the pulsating control chamber formed with said outlet passageway to prevent the oscillating member from closing the outlet passageway.

9. The device according to claim 8, wherein both faces of each oscillating disc are concave, and the face of each pulsating control chamber formed with said inlet passageway is convex and has a radius of curvature slightly smaller than the radius of curvature of the respective face of the oscillating disc, such that the contacting faces of the oscillating disc and inlet passageway of each pulsating control chamber diverge away from each other.

10. A pulsating spraying device, comprising:

a housing having an inlet for a liquid under pressure, and a plurality of discharge openings for discharging the liquid;

an inlet chamber communicating with said housing inlet;

a plurality of pulsating control chambers each including an inlet passageway on one side communicating with said inlet chamber, and an outlet passageway on the opposite side communicating with at least one of said discharge openings;

and a plurality of freely-movable oscillating discs, one located in each of said pulsating control chambers, rapidly oscillated by the flow of liquid into the respective pulsating control chamber via its inlet passageway, to drive the liquid via its outlet passageway out of the respective discharge opening in the form of high-frequency pulses;

said plurality of discharge openings being formed in a selector disc in alignment with said outlet passageways.

11. The device according to claim 10, wherein said selector disc includes at least first and second groups of discharge openings, and is movable to selectively align either group of discharge openings with respect to the respective outlet passageways of the pulsating control chambers.

12. The device according to claim 11, wherein said first group of discharge openings includes a single discharge opening for each of said pulsating control chambers, and said second group of discharge openings includes at least two discharge openings, each of smaller cross-sectional area than the discharge openings of said first group, for each of said pulsating control chambers.

13. A pulsating spraying device comprising:

a housing having an inlet for a liquid under pressure, and a plurality of discharge openings for discharging the liquid;

at least one pulsating control chamber having an inlet passageway on one side communicating with said housing inlet, and an outlet passageway on the opposite side communicating with at least one of said discharge openings;

and an oscillating member in said pulsating control chamber rapidly oscillated by the flow of liquid into said chamber via its inlet passageway, to drive the liquid via its outlet passageway out of the respective discharge opening in the form of pulses;

said plurality of discharge openings being formed in a selector disc which is movable to selectively align the discharge openings with respect to the outlet passageway of the pulsating control chamber.

14. The device according to claim 13, wherein said outlet passageway from the pulsating control chamber includes a section extending radially of the housing, said housing selector disc including at least first and second groups of discharge openings, and being rotatable about the axis of the housing to align either group of discharge openings with said radially-extending section of said outlet passageway.

15. The device according to claim 13, wherein said housing includes:

a main housing section formed at one side with said inlet;

a closure plate fixed to the opposite side of the main housing section;

and an intermediate plate between said main housing section and said closure plate;

said intermediate plate being formed with said inlet passageway through one face communicating with said inlet and being further formed in its opposite face with a cavity communicating with said inlet passageway and defining a part of the respective pulsating control chamber;

said closure plate also being formed with a cavity in one face defining the pulsating control chamber with the cavity of the intermediate plate, and being further formed with said outlet passageway through its opposite face alignable with the discharge openings in said selector disc.

16. The device according to claim 13, wherein said oscillating member is formed with one face facing the inlet passageway of the pulsating control chamber and configured to open and close said inlet passageway during the oscillations of the oscillating member; and wherein said pulsating control chamber is formed with spacer means spacing the opposite face of the oscillating member from the face of the pulsating control chamber formed with said outlet passageway so as to prevent the oscillating member from closing the outlet passageway.

17. The device according to claim 16, wherein both faces of the oscillating members are concave, and the face of the pulsating control chamber formed with said inlet passageway is convex and has a radius of curvature slightly smaller than the radius of curvature of the respective face of the oscillating member, such that the contacting faces of the oscillating member and inlet passageway of the pulsating control chamber diverge away from each other.

18. The device according to claim 13, wherein there are a plurality of pulsating control chambers, each having an oscillating member and an outlet passageway, arranged in a circular array around the axis of the housing; said selector disc being rotatable about said axis of the housing to selectively align the discharge openings with respect to the outlet passageways of the pulsating control chambers.

* * * * *